US006384792B2

(12) United States Patent
Apostolos

(10) Patent No.: US 6,384,792 B2
(45) **Date of Patent: *May 7, 2002**

(54) NARROWBAND/WIDEBAND DUAL MODE ANTENNA

(75) Inventor: John T. Apostolos, Merrimack, NH (US)

(73) Assignee: BAE SystemsInformation Electronic Systems Integration, Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/882,783

(22) Filed: Jun. 14, 2001

Related U.S. Application Data

(60) Provisional application No. 60/211,429, filed on Jun. 14, 2000.

(51) Int. Cl.[7] ..... H01Q 11/14
(52) U.S. Cl. ..... 343/744; 343/745
(58) Field of Search ..... 343/744, 895, 343/745, 846, 741, 742, 748, 700 MS; H01Q 11/14

(56) References Cited

U.S. PATENT DOCUMENTS

| | | | | |
|---|---|---|---|---|
| 3,946,392 A | | 3/1976 | Whitman | 343/830 |
| 4,809,009 A | | 2/1989 | Grimes et al. | 343/726 |
| 4,864,314 A | | 9/1989 | Bond | 343/700 MS |
| 5,485,167 A | | 1/1996 | Wong et al. | 343/753 |
| 5,627,550 A | | 5/1997 | Sanad | 343/700 MS |
| 5,767,810 A | * | 6/1998 | Hagiwara et al. | 343/700 MS |
| 5,784,032 A | * | 7/1998 | Johnston et al. | 343/702 |
| 5,790,080 A | | 8/1998 | Apostlos | 343/744 |
| 6,008,762 A | | 12/1999 | Nghiem | 343/700 MS |
| 6,025,812 A | | 2/2000 | Gabriel et al. | 343/797 |
| 6,028,567 A | | 2/2000 | Lahti | 343/895 |
| 6,034,637 A | | 3/2000 | McCoy | 343/700 MS |
| 6,069,587 A | | 5/2000 | Lynch et al. | 343/700 MS |
| 6,124,831 A | | 9/2000 | Rutkowski et al. | 343/700 MS |
| 6,147,647 A | | 11/2000 | Tassoudji et al. | 343/700 MS |
| 6,154,176 A | | 11/2000 | Fathy et al. | 343/700 MS |

OTHER PUBLICATIONS

PCT International Search Report dated Nov. 6, 2001 of International Application No. PCT/US01/19346 filed Jun. 14, 2001.

* cited by examiner

*Primary Examiner*—Hoanganh Le
(74) *Attorney, Agent, or Firm*—Scott J. Asmus; Vernon C. Maine

(57) ABSTRACT

The present invention features a dual mode, meander line loaded antenna (MLA) having an additional wideband plate or hat located above the horizontal top surface of the MLA antenna. The upper plate is spaced a predetermined distance above the MLA and held in place by dielectric blocks of a predetermined thickness. By properly spacing the additional plate, simultaneous wideband and narrowband reception can be performed. The added upper plate generally does not interfere with the usual narrowband operation of the original antenna structure. The modified antenna can accept radio frequency signals across a wide range of frequencies. The additional upper plate can be retrofitted to existing MLAs to modify them for dual mode operation.

19 Claims, 5 Drawing Sheets

NARROWBAND/WIDEBAND DUAL MODE ANTENNA

CROSS REFERENCE TO RELATED APPLICATIONS

This application claims priority to U.S. Provisional Patent Application Serial No. 60/211,429, filed Jun. 14, 2000. This application is also related to previously issued U.S. Pat. No. 5,790,080 for a MEANDER LINE LOADED ANTENNA, which is hereby incorporated by reference.

FIELD OF THE INVENTION

This invention pertains to the field of antennas and, more particularly, to a dual mode meander line loaded antenna (MLA) providing simultaneous dual wideband and narrowband operation.

BACKGROUND OF THE INVENTION

Existing MLA antennas are typically narrow band antennas. For many narrowband military and commercial applications, radio frequency signals can appear unexpectedly across a wide frequency range. These existing MLA antennas are not capable of working effectively in such an environment.

In the prior art, efficient antennas have typically required structures with minimum dimensions on the order of a quarter wavelength of their intended radiating frequency. These dimensions allowed the antennas to be easily excited and to be operated at or near their resonance, limiting the energy dissipated in resistive losses and maximizing the transmitted energy. These antennas tended to be large in size at their resonant wavelengths. Further, as the operating frequency decreased, the antenna's dimensions were increased proportionally. In order to address the shortcomings of traditional antenna design and functionality, the meander line loaded antenna (MLA) was developed. The basic theory and design of the meander line loaded antenna is presented in U.S. Pat. No. 5,790,080.

An example of a basic prior art MLA, also termed a varied impedance transmission line antenna, is shown in FIG. 1. The antenna 100 consists of two vertical sections (i.e., plates) 102 and a horizontal section 104. The vertical and horizontal sections 102, 104, respectively, are separated by gaps 106. Also part of the antenna 100 are the meander lines 200 (FIG. 2), which are typically connected between the vertical and horizontal sections 102, 104 at the gaps 106.

The meander line 200 is designed to adjust the electrical (i.e., resonant) length of the antenna 100. The design of the meander slow wave structure 200 is such that it is possible to switch lengths of the meander line 200 in or out of the circuit quickly and with negligible loss, in order to change the effective electrical length of the antenna 100. This switching is possible because the active switching devices (not shown) are always located in the high impedance sections of the meander line 200. This keeps the current through the switching devices (not shown) low and results in very low dissipation losses in the switches, thereby maintaining high antenna efficiency. Switching of sections of a meander line using mechanical, electrical, microelectromechanical systems (MEMS) switches, or the like, are well known to those skilled in the antenna design arts.

The basic antenna of FIG. 1 can be operated in a loop mode that provides a "figure eight" coverage (i.e., radiation) pattern. Horizontal polarization, loop mode, is obtained when the antenna is operated at a frequency such that the electrical length of the entire line including the meander lines 200 is a multiple of full wavelength as shown in FIG. 3C.

The antenna can also be operated in a vertically polarized mode, monopole mode, by adjusting the electrical length to an odd multiple of a half wavelength at the operating frequency, FIGS. 3B and 3D, respectively. The meander lines 200 can be tuned using electrical or mechanical switches (not shown) to change the mode of operation at a given frequency or to switch frequencies using a given mode.

The meander line loaded antenna allowed the physical antenna dimensions to be significantly reduced in size while maintaining electrical lengths that were still multiples of a quarter wavelength. Antennas and radiating structures built using this design approach operate in the region where the limitation on their fundamental performance is governed by the Chu-Harrington relation:

$$\text{Efficiency}=FV_2Q$$

where: Q=Quality Factor;

$V_2$=Volume of the structure in cubic wavelengths; and

F=Geometric Form Factor (F=64 for a cube or a sphere)

Meander line loaded antennas achieve the efficiency limit of the Chu-Harrington relation while allowing the antenna size to be much smaller than a wavelength at the frequency of operation. Height reductions of 10 to 1 over quarter wave monopole antennas can be realized, while achieving comparable gain.

But, the existing MLA antennas are narrowband antennas. For many narrowband military and commercial applications where signals can appear unexpectedly across a wide frequency range, the existing MLA antennas are not desirable.

DISCUSSION OF THE RELATED ART

U.S. Pat. No. 5,790,080 entitled MEANDER LINE LOADED ANTENNA, describes an antenna that includes one or more conductive elements for acting as radiating antenna elements, and a slow wave meander line adapted to couple electrical signals between the conductive elements. The meander line has an effective electrical length that affects the electrical length and operating characteristics of the antenna. The electrical length and operating mode of the antenna may be readily controlled.

U.S. Pat. No. 6,034,637 entitled DOUBLE RESONANT WIDEBAND PATCH ANTENNA AND METHOD OF FORMING SAME, describes a double resonant wideband patch antenna that includes a planar resonator forming a substantially trapezoidal shape having a non-parallel edge for providing a substantially wide bandwidth. A feed line (107) extends parallel to the non-parallel edge for coupling while a ground plane extends beneath the planar resonator for increasing radiation efficiency.

U.S. Pat. No. 6,008,762 entitled FOLDED QUARTER-WAVE PATCH ANTENNA, describes a folded quarter-wave patch antenna which includes a conductor plate having first and second spaced apart arms. A ground plane is separated from the conductor plate by a dielectric substrate that is approximately parallel to the conductor plate. The ground plane is electrically connected to the first arm at one end and a signal unit is electrically coupled to the first arm. The signal unit transmits and/or receives signals having a selected frequency band. The folded quarter-wave patch antenna can also act as a dual frequency band antenna. In dual frequency band operation, the signal unit provides the antenna with a first signal of a first frequency band and a second signal of a second frequency band.

Each antenna of the prior art devices requires the use of multiple, separate wideband and narrowband antennas. What is needed is a means to provide a wideband receive capability, while simultaneously receiving narrowband signals on the same MLA antenna. Such an antenna should be simple and inexpensive to manufacture and also enable retrofitting of existing MLA antennas.

SUMMARY OF THE INVENTION

In accordance with the present invention, there is provided a dual mode, meander line loaded antenna (MLA) having an additional wideband plate or hat located above the horizontal top surface of the antenna. The upper plate is spaced a predetermined distance above the MLA and held in place by dielectric blocks of a predetermined thickness. By properly spacing the additional plate, simultaneous wideband and narrowband reception can occur. The added upper plate generally does not interfere with the usual narrowband operation/reception of the original antenna structure. The modified antenna can accept radio frequency signals appearing unexpectedly across a wide range of frequencies. The additional upper plate can be retrofitted to existing meander line loaded antennas to modify them for dual mode operation. The narrowband/wideband dual mode antenna operates simultaneously a wideband signal and a narrowband signal.

It is therefore an object of the invention to provide a MLA antenna capable of simultaneous dual mode operation. One of the facets of the invention is to insert a structure that does not effect the existing tunable high frequency MLA antenna usage. In one embodiment, the additional structure is placed a few inches above the horizontal MLA section. Using the voltage induced between the structure and the horizontal section as the input to a high impedance field effect transistor (FET), the incidence vertical electric fields are detected simultaneous with the normal narrowband operation of the MLA antenna.

It is a further object of the invention to provide a MLA antenna where the simultaneous dual operating modes are a broadband and a narrowband mode of operation. It is another object of the invention to provide a MLA antenna suitable for use in environments where signals may appear unexpectedly over a wide range of frequencies. It is a still further object of the invention to provide a MLA antenna suitable for use in wideband signal acquisition applications, while simultaneously performing direction finding.

Another object is a narrowband/wideband dual mode antenna comprising a meander line loaded antenna (MLA) having a pair of vertical sections disposed substantially perpendicular to a ground plane, one of the pair of vertical sections being electrically connected to the ground plane. There is a substantially horizontal top section disposed above and substantially perpendicular to the pair of vertical sections, each end of the top section being proximate one of the pair of vertical sections and separated therefrom by a gap. One or more meander line elements are proximate at least one of the gaps and operatively connected to one of the vertical sections and to the top section. A wideband plate is disposed a predetermined distance above and electrically isolated from the horizontal top section. And, there is a feed means for accepting a voltage induced between the wideband plate and the top section by an incoming signal.

And another object is the narrowband/wideband dual mode antenna, wherein the feed means is a high impedance amplifier. Furthermore, wherein the high impedance amplifier is a field effect transistor (FET) having a gate, a drain, and a source, wherein the gate is connected to the wideband plate, the source is connected to the top section, and the drain is connected to the vertical section electrically connected to the ground plane.

Yet a further object is the narrowband/wideband dual mode antenna wherein the electrical isolation between the wideband plate and the horizontal top section is provided by a dielectric material. In one embodiment there is at least one dielectric block, although other separating means are within the scope of the invention. The dielectric material can be any high-frequency dielectric material such as Teflon7, polyethylene, and phenolic.

An additional object is the narrowband/wideband dual mode antenna wherein the meander line loaded antenna is a tunable, varied impedance transmission line. And, wherein the tunable, varied impedance transmission line comprises switching means for selectively connecting and disconnecting at least a portion of the transmission line.

Another object is the narrowband/wideband dual mode antenna wherein the meander line is a printed circuit structure.

And, an object includes the narrowband/wideband dual mode antenna wherein the meander line elements are electrically isolated from the horizontal top section by a dielectric material. And, the narrowband/wideband dual mode antenna further comprising at least one dielectric bar disposed between at least two of the structures, the ground plane, at least one of the pair of vertical sections, and the substantially horizontal top section. Further comprising fastening means for securing at least one dielectric bar to one of the structures, wherein the fastening means comprises at least one from the group of screw, bolt, and adhesive.

An object of the invention is a method for operating dual bandwidths using a meander line loaded antenna (MLA), comprising the steps of providing an MLA having a pair of vertical sections disposed substantially perpendicular to a ground plane, one of the pair of vertical sections being electrically connected to the ground plane, with a substantially horizontal top section disposed above and substantially perpendicular to the pair of vertical sections, each end of the top section being proximate one of the pair of vertical sections and separated therefrom by a gap, and with one or more meander lines proximate at least one of the gaps and operatively connected to at least one of the vertical sections and to the top section. Disposing a wideband plate at a predetermined distance above and electrically isolated from the horizontal top section by at least one dielectric block, and securing the wideband hat to the dielectric block. Providing wideband feed means electrically connected to the horizontal top section and the wideband hat for accepting a voltage induced between the wideband hat and the horizontal top section by an incoming radio frequency signal, whereby the dual mode antenna receives simultaneous broadband and narrowband signals.

And a further object is the method for operating dual bandwidths, further comprising the step of electrically connecting the vertical section connected to the feed means, wherein the connecting does not cross the gap.

It is an additional object of the invention to provide a MLA antenna incorporating a wideband mode plate to allow simultaneous dual mode operation. It is another object of the invention to provide a MLA antenna having a wideband hat section that may be retrofitted to existing narrowband meander line loaded antennas.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The present invention provides a dual-mode, meander line loaded (MLA) antenna capable of simultaneous broadband and a narrowband operating modes.

Figure 1:
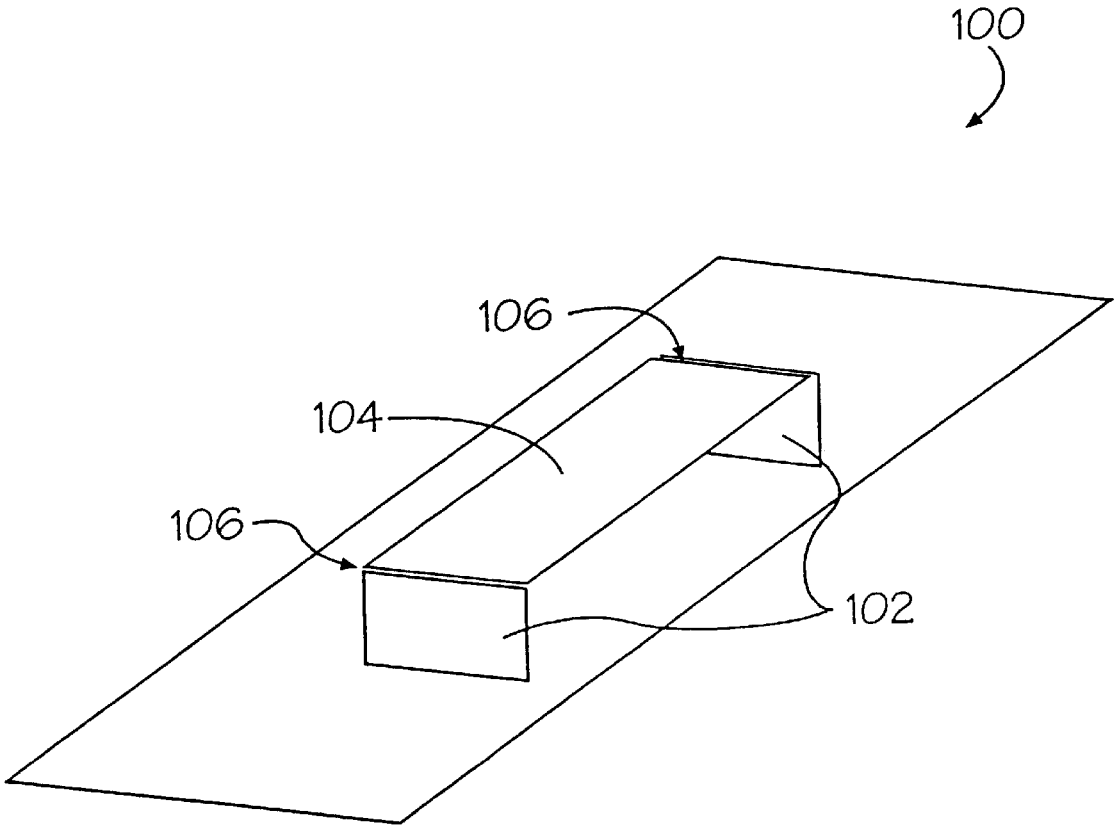
Prior Art Figure 1
FIG. 1 is a schematic, perspective view of a simple MLA loop antenna of the prior art.
Figure 2:
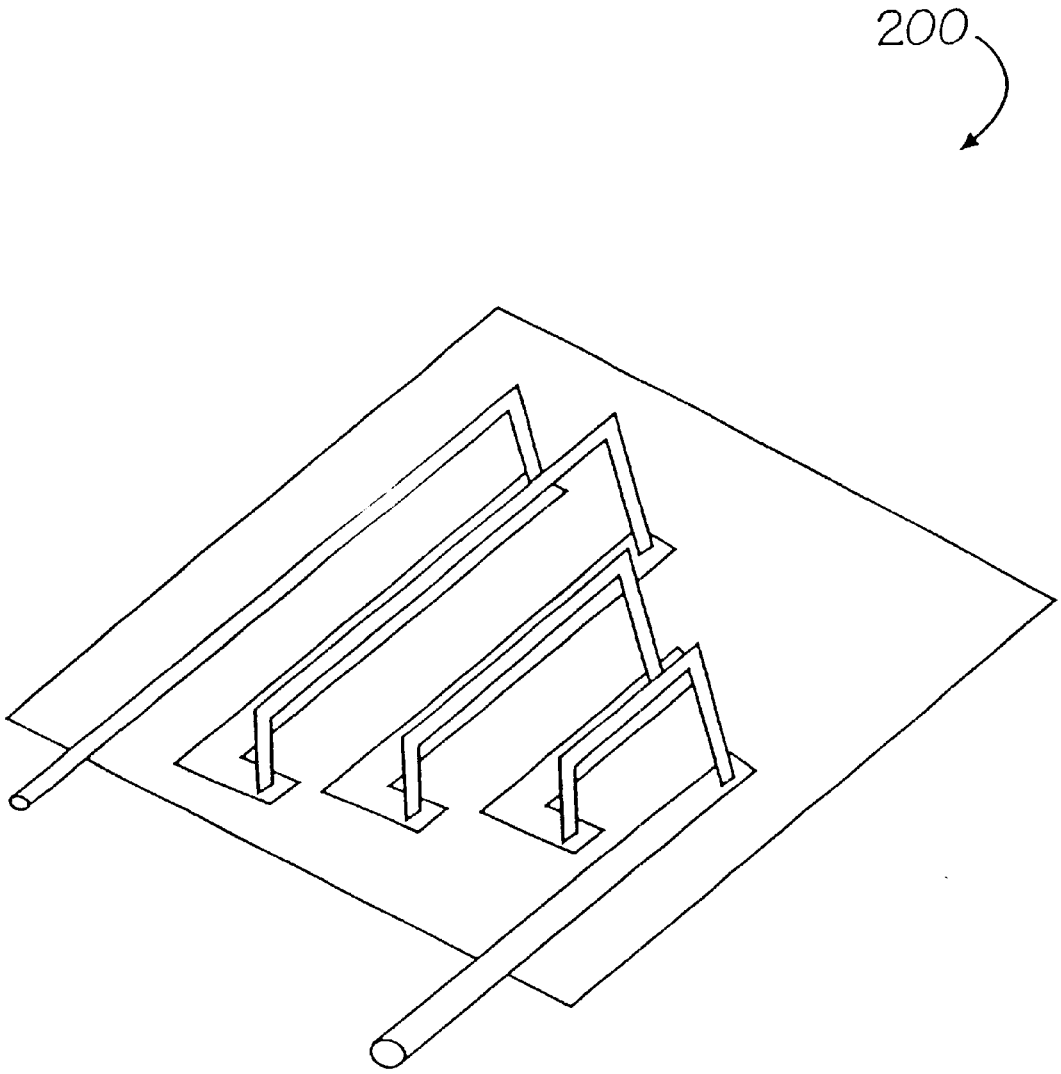
FIG. 2 is a schematic, perspective view of a meander line structure suitable for use with the antenna of FIG. 1.
Figure 3A:
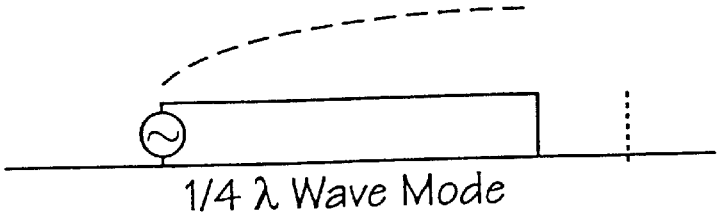
FIGS. 3A–3D are a series of comparative diagrams showing various possible operating modes of the antenna of FIG. 1.
Figure 3B:
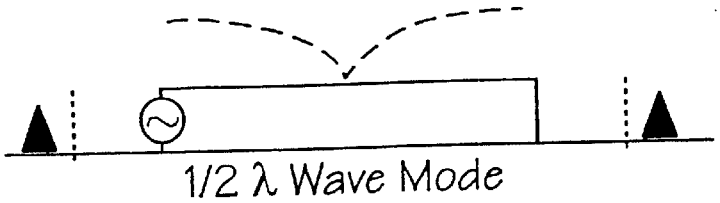
Figure 3C:
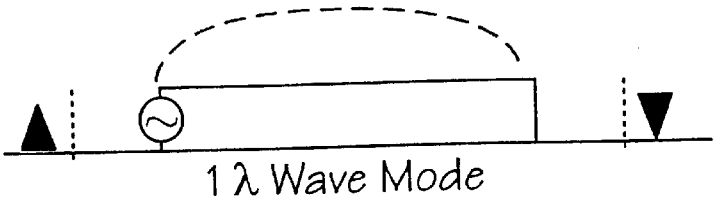
Figure 3D:
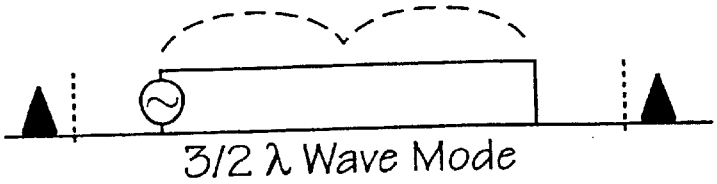

Referring again to FIGS. 1 and 2, there are shown cross-sectional, schematic views of an MLA loop antenna 100 of the prior art (FIG. 1) and an associated variable impedance line section 200 (FIG. 2) suitable for use with the antenna 100. The construction and operation of such antennas are detailed in U.S. Pat. No. 5,790,080.

These existing MLA antennas are typically narrow band antennas. For many narrowband military and commercial applications, radio frequency signals can appear unexpectedly across a wide frequency range. These existing MLA antennas are not capable of working effectively in such an environment.

The present invention provides an antenna assembly based on prior MLA antenna structures but which is capable of meeting the dual wideband/narrowband operating requirements of many applications. This provides an antenna having the capability to acquire signals over a wide frequency bandwidth while simultaneously receiving narrowband signals. The wideband (e.g., 2 MHz to 30 MHz) reception capability of the antenna of the present invention is created by adding a structure above a traditional meander line antenna that does not affect the existing tunable high frequency meander line antenna.

Figure 4:
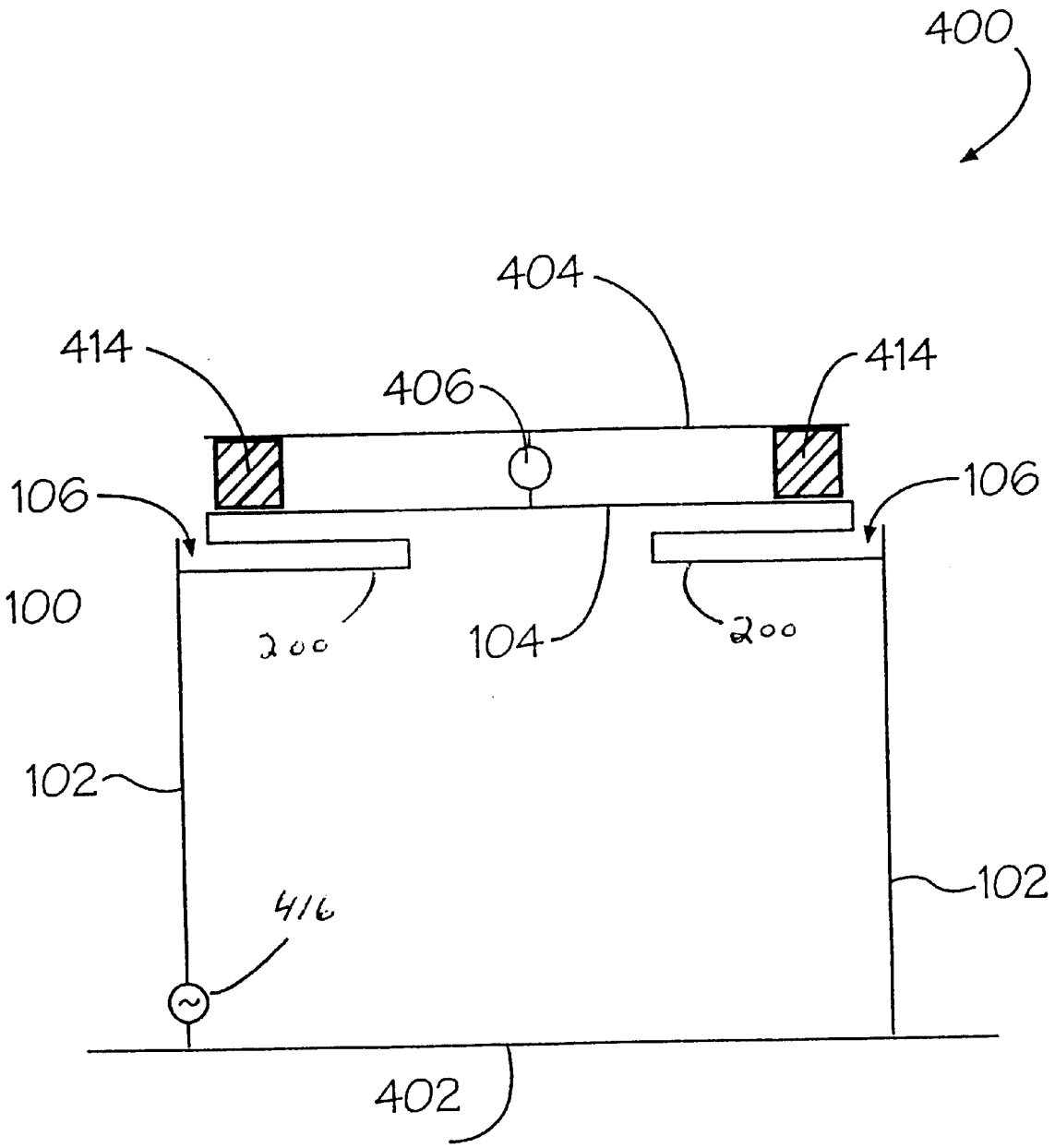
FIG. 4 is a cross-sectional, electrical schematic view of the inventive antenna showing the wideband plate of the invention.
Figure 5:
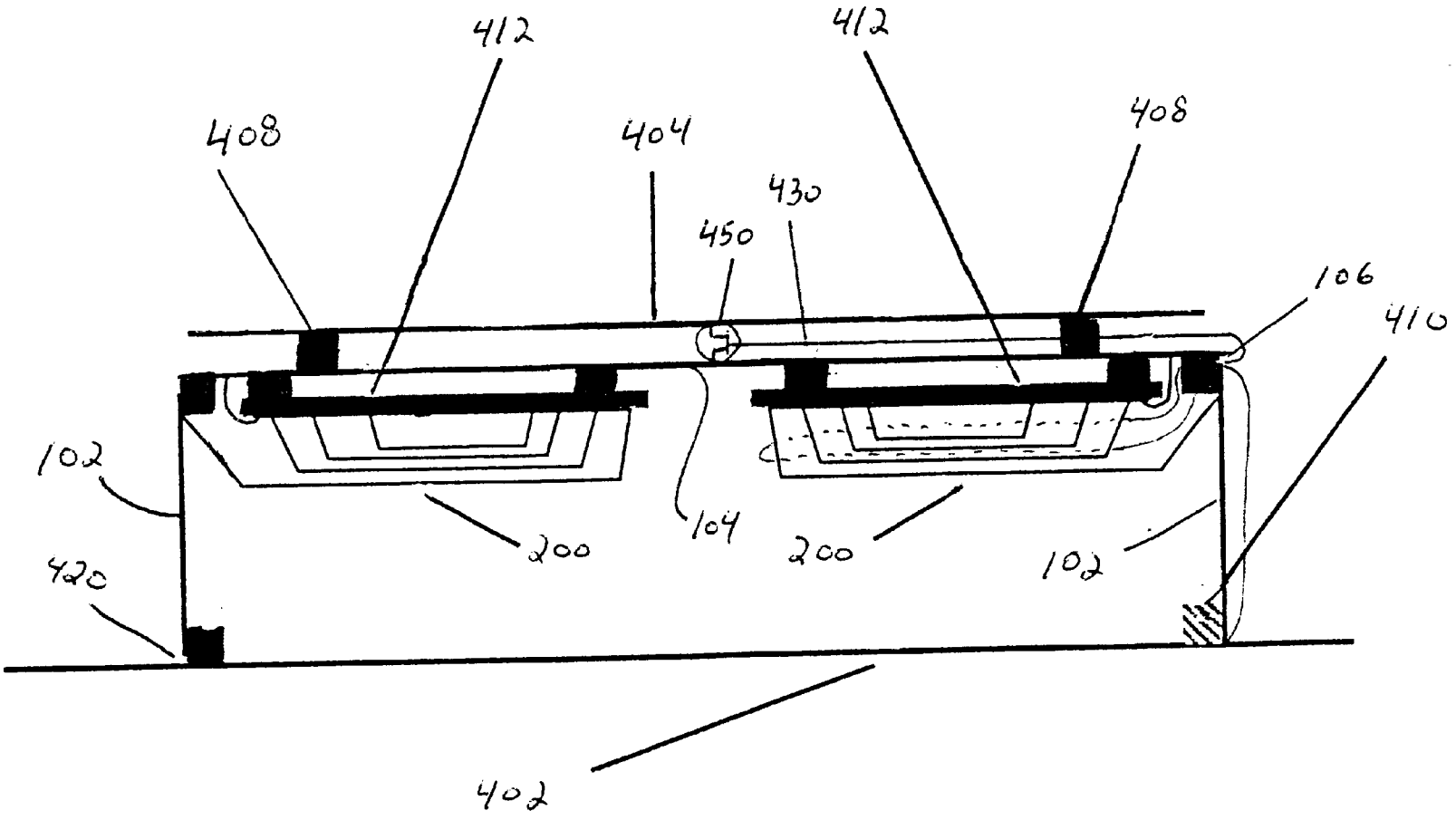
FIG. 5 is a cross-sectional, schematic view of the inventive antenna showing the placement of dielectric material in the antenna structure.

Referring now to FIG. 4, there is shown a cross sectional, schematic view of the inventive antenna structure 400. A typical MLA loop antenna 100 consisting of vertical sections 102, horizontal section 106 and having gaps 106 bridged by meander lines 200, is shown disposed above a ground plane 402. A horizontal plate 404 is disposed substantially parallel and above the horizontal MLA section 104 at a spacing determined by the intended operating characteristics of the antenna. The spacing can be maintained by using a few dielectric sections 414 or posts to maintain the respective distance between the horizontal plate and the MLA section. Distinguished from the prior art MLA, one of the vertical sides 102 is not connected to the ground plane as shown in FIG. 5. The feed 416 is illustrated to depict the signal that is produced by having the vertical side 102 in an ungrounded state.

For example, based upon empirical data gathered from experimentation, a gap of approximately 3 inches has been shown effective for wideband operation in a range of frequencies between approximately 2 MHz and 30 MHz. In effect, the narrowband operation of the MLA, for example 100 KHz, now simultaneously has a wideband range due to the wideband cap of between, for example, 2 MHz and 30 MHz. This frequency band is merely illustrated as an example of one of the more commercially viable bands. This example is chosen for purposes of disclosure and it will be obvious to those skilled in the antenna design arts that other spacings could be chosen to meet a particular frequency band operating requirement. Furthermore, the narrowband signal can be tuned to any signal using the switching means discussed in the prior art.

By using a voltage (shown schematically as voltage source 406 ) induced between the horizontal plate 404 and the horizontal section 104 of antenna 100 as the input to a high impedance amplifier (not shown) having an input impedance greater than about 1000 ohms, it is possible to detect incident vertical electronic fields (i.e., induced voltage 406 ) while not disturbing the normal narrowband operation of antenna 100. The high impedance amplifier can be a field effect transistor (FET) device or the like. This single antenna having dual mode operating characteristics can replace a separate acquisition antenna.

Simulations of the inventive antenna structure show that the efficiency of the wideband mode approaches the Chu limit, which is given by:

$$\text{Efficiency}=FV_2Q$$

where: Q=Quality Factor;

$V_2$=Volume of the structure in cubic wavelengths; and

F=Geometric Form Factor (F=64 for a cube or a sphere)

The gain of the antenna (dBI) can then be calculated by multiplying the directivity of the antenna by the efficiency. The results of the simulations for a 2 MHz to 30 MHz narrowband and wideband dual mode antenna with dimensions 12 inches×12 inches×36 inches are shown in Table 1 of the computer simulations. Both the narrowband gain and the wideband gain are illustrated.

TABLE 1

| Frequency [MHz] | Wideband Gain [dBI] | Narrowband Gain [dBI] |
|---|---|---|
| 30 | −15 | +2 |
| 20 | −21 | −4 |
| 10 | −30 | −13 |
| 3 | −45 | −25 |

Referring now also to FIG. 5, there is shown a cross sectional view of the inventive antenna structure showing construction details thereof. One of the vertical radiating sections 102 are attached to the ground plane 402 and the other has a gap 420 separating the one vertical side 102 from the ground plane. Either side can have the gap or separation 420. A pair of meander line antennas 200 are resident at the gaps 106 with connections to the vertical and horizontal sections 102, 104. In this embodiment the MLA elements 200 are secured to a dielectric material 412, which would normally be connected directly to the horizontal plate 104. The embodiment shown in FIG. 5 has the dielectric substrate 412 separated from the horizontal plate 104 by one ore more spacers 422 that are spaced from the horizontal section 104 by spacers 422, although spacers are not necessary. Furthermore, the dimensions of FIG. 5 are not representative of the actual dimensions of the various distances.

In one embodiment, the high impedance amplifier 450 is connected via a coaxial cable 430, preferably insulated, that runs from the grounded vertical side 102 around the structure and wound about the meander line 200. The cable 430 electrically the Drain of a FET 450, with the Gate connecting to the wideband plate 404 and the Source connecting to the horizontal top cover 104. The coaxial cable 430 is snaked around the various elements to avoid jumping gaps that could de-tune the device and connects to the vertical side 102.

In one embodiment the vertical sections 102 are structurally interconnected by the use of rectangular bars of dielectric material 420. The bars 420 maintain the shape and assist in keeping the separation 420 of the vertical side intact. Any high frequency dielectric material could be used, such as polytetrafluoroethylene (Teflon7), polyethylene and phenolic. Other suitable materials well known to those skilled in the antenna design arts could also be used. The sections 102, 104 are fastened to the dielectric bars 420 with screws, bolts, or other suitable fasteners (not shown), including adhesives and adhesive tapes.

An optional additional bar 410 is located between the grounded vertical side 102 and ground plane 402. The material used in the bar 410 may be either a dielectric or a conductor, because vertical side 102 is grounded to the ground plane 402. For this attachment, welding or soldering would also provide a suitable attachment method. For all of the other attachments, the use of the dielectric 408 is useful to maintain the insulation of one section from another as well as the structural integrity. The dielectric used and the gap between the sections at these locations must be sufficient to prevent field breakdown at the field strengths for which the antenna is designed to operate.

The meander lines 200 are attached to the top section 104 by means of rectangular dielectric spacer bars 420 and fasteners, such as screws or bolts (not shown) or other fasteners or adhesives. A sheet of dielectric material 412 is used to provide support for the meander line 200 while electrically isolating it from the section 104. Attachment points for meander line 200 other than horizontal section 102 may be chosen if their location is more convenient for a particular implementation of the antenna.

In alternate embodiments, meander line 200 could be manufactured from printed circuit board material and therefore be designed to attach directly to the top section 104 by soldering or using screws. In this approach, one side of the printed circuit board material would be in contact with the top section 104 and the other side of the printed circuit board would have parts of the meander line circuit etched into it. The board material itself would act as the dielectric insulator. Such printed circuit board technology is known in the art.

In one embodiment, the wideband hat (wideband plate) 404 is attached to the top section of the antenna 100 by means of two rectangular bars of dielectric material 408, as shown in FIG. 5, using screws or bolts (not shown) for fasteners. The substantially horizontal uppermost plate 404 forms a wideband hat that is excited by meander line antenna currents in the horizontal section 104. This excitation gives rise to a potential difference 406 between the hat 404 and the horizontal section 104. The induced waves can arise from vertically polarized waves induces a volt difference between the wideband plate and the top cover.

The high input impedance amplifier 450 picks up the voltage 406 (FIGS. 4, 5). The amplifier's input impedance Z at the resonant frequency, $f_0$, is given by:

$$Z=(X^2+R^2)^{0.5}$$

Where: X=reactance

R=resistance

The reactance and the resistance of the antenna and can be used to design the antenna for optimal power transfer. The resonance frequency can be calculated by taking the geometric mean, for example the geometric mean of the 2–30 MHz range is about 24 MHz The antenna of the present invention provides several advantages over the antenna structures of the prior art. One advantage is that the inventive antenna occupies a relatively low volume. This, along with the instantaneous bandwidth for signal acquisition and the simultaneous narrowband reception capability, results in antenna performance unmatched in prior art antenna structures. As a result, fewer antennas are required. In airborne applications, fewer antennas results in a reduced radar cross section, always a desirable attribute. In installations where MLA antennas are already in place, the wideband capability can be retrofitted to these existing antennas.

While the efficiency of the wideband antenna is relatively low, for signal acquisition, this is not a significant problem and the advantages of the inventive antenna more than compensate for this characteristic.

Typical applications foreseen for the inventive antenna are commercial use for cell phone bands, PCS and PHS applications where there may be an economic advantage to having a wideband signal acquisition capability to detect new signals before assigning a narrowband channel to them. Presently, the main applications are likely to be on military platforms such as air or spacecraft.

Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A narrowband/wideband dual mode antenna comprising:

a) meander line loaded antenna (MLA) comprising: a pair of vertical sections disposed substantially perpendicular to a ground plane, one of said pair of vertical sections being electrically connected to said ground plane; a substantially horizontal top section disposed above and substantially perpendicular to said pair of vertical sections, each end of said top section being proximate one of said pair of vertical sections and separated therefrom by a gap; one or more meander line elements proximate at least one of said gaps and operatively connected to one of said vertical sections and to said top section;

b) a wideband plate disposed a predetermined distance above and electrically isolated from said horizontal top section; and c) a feed means for accepting a voltage induced between said wideband plate and said top section by an incoming signal.

2. The narrowband/wideband dual mode antenna according to claim 1, wherein said feed means is a high impedance amplifier.

3. The narrowband/wideband dual mode antenna according to claim 2, wherein said high impedance amplifier is a field effect transistor (FET) having a gate, a drain, and a source, wherein said gate is connected to said wideband plate, said source is connected to said top section, and said drain is connected to said vertical section electrically connected to said ground plane.

4. The narrowband/wideband dual mode antenna according to claim 1, wherein said electrical isolation between said wideband plate and said horizontal top section is provided by a dielectric material disposed therebetween.

5. The narrowband/wideband dual mode antenna according to claim 4, wherein said dielectric material is selected from the group: polytetrafluoroethylene, polyethylene, and phenolic.

6. The narrowband/wideband dual mode antenna according to claim 1, wherein said meander line loaded antenna is a tunable, varied impedance transmission line.

7. The narrowband/wideband dual mode antenna according to claim 6, wherein said tunable, varied impedance transmission line comprises switching means for selectively connecting and disconnecting at least a portion of said transmission line for tuning a narrowband signal.

8. The narrowband/wideband dual mode antenna according to claim 1, wherein said dual mode antenna simultaneously operates with a wideband signal and a narrowband signal.

9. The narrowband/wideband dual mode antenna according to claim 1, wherein said meander line loaded antenna is a printed circuit structure.

10. The narrowband/wideband dual mode antenna according to claim 4, wherein said dielectric material is at least one dielectric bar disposed between at least two of the structures: said ground plane, at least one of said pair of vertical sections; and said substantially horizontal top section.

11. The narrowband/wideband dual mode antenna according to claim 1 wherein said meander line elements are electrically isolated from said horizontal top section by a dielectric material.

12. The narrowband/wideband dual mode antenna according to claim 10, further comprising fastening means for securing said at least one dielectric bar to one of said at least two structures.

13. The narrowband/wideband dual mode antenna according to claim 12, wherein said fastening means comprises at least one from the group of: screw, bolt, and adhesive.

14. A method for operating dual bandwidths using a meander line loaded antenna (MLA), comprising the steps of:

a) providing an MLA comprising: a pair of vertical sections disposed substantially perpendicular to a ground plane, one of said pair of vertical sections being electrically connected to said ground plane; a substantially horizontal top section disposed above and substantially perpendicular to said pair of vertical sections, each end of said top section being proximate one of said pair of vertical sections and separated therefrom by a gap; one or more meander lines proximate at least one of said gaps and operatively connected to at least one of said vertical sections and to said top section;

b) disposing a wideband plate at a predetermined distance above and electrically isolated from said horizontal top section by at least one dielectric block;

c) securing said wideband plate to said at least one dielectric block; and d) providing a feed means electrically connected to said horizontal top section and said wideband plate for accepting a voltage induced between said wideband hat and said horizontal top section by an incoming signal, whereby said dual mode antenna receives simultaneous broadband and narrowband signals.

15. The method for operating dual bandwidths according to claim 14, further comprising the step of electrically connecting said vertical section to said feed means, wherein said connecting does not cross said gap.

16. The method for operating dual bandwidths according to claim 14, wherein said dielectric block comprises at least one high-frequency dielectric material from the group: polytetrafluoroethylene, polyethylene, and phenolic.

17. The method for operating dual bandwidths according to claim 14, wherein said meander line is a tunable, varied impedance transmission line.

18. The method for operating dual bandwidths according to claim 17, wherein said tunable, varied impedance transmission line comprises switching means for selectively connecting and disconnecting at least a portion of said variable impedance transmission line from the remaining portion thereof, thereby tuning said narrowband signals.

19. The method for operating dual bandwidths according to claim 14, wherein said meander line loaded antenna is manufactured by printed circuit techniques.

* * * * *